United States Patent [19]

Suzuki

[11] 4,277,823

[45] Jul. 7, 1981

[54] EASY-TO-ASSEMBLE LAMP

[75] Inventor: Akira Suzuki, Tokyo, Japan

[73] Assignee: Kazusuke Takagi, Tokyo, Japan; a part interest

[21] Appl. No.: 56,431

[22] Filed: Jul. 10, 1979

[30] Foreign Application Priority Data

Dec. 25, 1978 [JP] Japan ..... 53-177896[U]

[51] Int. Cl.[3] ..... F21V 1/06

[52] U.S. Cl. .....362/352; 362/358

[58] Field of Search ..... 362/352, 351, 353, 358, 362/360, 431, 801, 806, 812, 450, 367

[56] References Cited

U.S. PATENT DOCUMENTS

| | | | |
|---|---|---|---|
| 2,752,482 | 6/1956 | Smith | 362/358 |
| 4,117,533 | 9/1978 | Hayelthorn | 362/367 |

*Primary Examiner*—Donald P. Walsh

*Attorney, Agent, or Firm*—Blakely, Sokoloff, Taylor & Zafman

[57] ABSTRACT

A lamp which can easily be disassembled and assembled comprising a frame structure composed of a plurality of frame units, upper and lower holders for holding three or more of said frame units in combination and a light globe socket on said upper or lower holder; and shade plates detachably engaged with the frame units respectively for enclosing said socket and defining the peripheral construction of the lamp. Said frame unit has a vertical pillar and a pair of frame arms transversely extending therefrom, the intermediate portion of the frame arms being bent to make an obtuse angle (about 120°). A plurality of said frame units are put together with the bent portion of the frame arms being inside and facing each other, and held by said upper and lower holder, then a light bulb socket is mounted on the upper or lower holder. Finally, the shade plates are slid along the pillar and are fixed to the frame units respectively to finish the lamp.

11 Claims, 4 Drawing Figures

EASY-TO-ASSEMBLE LAMP

BACKGROUND OF THE INVENTION

1. Field of the Invention

The present invention relates to a lamp which can be easily assembled and disassembled and the shape of which is easily changed.

2. Prior Art

Lamps are usually sold commercially as finished or almost finished goods. Some of them are of the do-it-yourself type, and the purchaser has to assemble the parts to have a finished lamp, but even these kits are relatively bulky and hard to transport. The reason is that, even if the lamp is sold as a do-it-yourself type, the lamp shade is usually constructed in one piece and the shade occupies a large space. Further, since the lamp shade is produced as one article the external appearance of the lamp is fixed and cannot be changed. So, if the user wishes to enjoy a lamp with a different external appearance, he has to buy a new one. This is expensive.

The present invention eliminates the disadvantage inherent in prior art lamps and lamp kits. The object of the present invention is to provide a lamp which, when disassembled, is compact enough to be transported in large quantities, which is easily assembled and disassembled, and the external appearance of which can be easily changed by simply increasing, decreasing or interchanging some of the parts, and which is easily adapted for use as a floor lamp, table lamp, desk lamp or ceiling or wall fixture.

SUMMARY OF THE INVENTION

The lamp of the present invention is constructed from a plurality of identically shaped frame units and shade plates which can be slidably engaged with the pillar of the frame units. Each frame unit is a rectangular frame (metal, wood or plastic) one end of which extends above and below the rectangle to constitute a pillar. The sides of the rectangle are bent at the mid-portion to make an obtuse angle. Three or more frame units are assembled with the apex of the obtuse angle being inside and are held at the top and bottom by respective holders to construct a frame. A socket for receiving a light bulb is installed at a suitable position within the frame and a cord for electric supply is connected to the socket. The shade plates have holding means on both right and left sides. The shade plates are installed by sliding the holding means onto a pillar and thereby the lamp is completed.

The lamp of the present invention as above described is constructed of relatively few parts, so it is easy to disassemble and re-assemble. One side of the frame unit is flat so the lamp parts make a compact package which can be easily handled and transported in large quantities. The external appearance of the lamp can be easily changed by increasing, decreasing or interchanging the parts or modifying the combination of the frame units. Also, since the lamp parts are of relatively simple construction they can be mass produced which makes it possible to reduce the cost of the lamp. The preferred embodiment of the present invention will be explained with reference to the drawings.

DETAILED DESCRIPTION OF THE INVENTION

Figure 1:
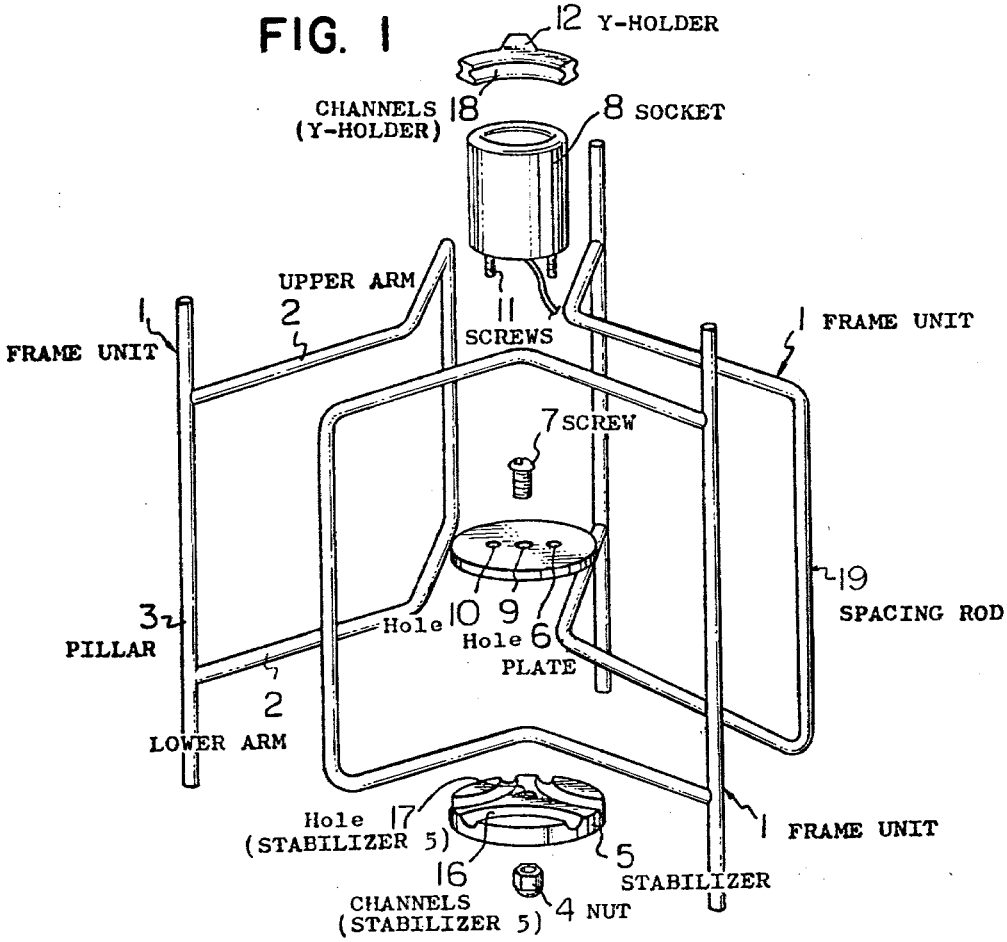
FIG. 1 is a perspective view showing the lamp disassembled.

FIG. 1 is a perspective view showing the first embodiment of the present invention disassembled and with the shade plates removed. The lamp of the present invention shown in FIG. 1 includes a plurality of frame units 1 (three frame units in FIG. 1) connectable to each other. Constructing the frame structure of the lamp (or lamp shade frame) are upper and lower holders 12, 5 for clamping the frame units, and a socket 8 for receiving and holding the light globe. A frame unit 1 comprises a pillar 3 which is one of the supports for the whole lamp when all parts are assembled to make a finished article, and a frame arm 2 integral with and transversely extending from said pillar 3, and bent at its intermediate portion so that a plurality of frame units can be combined in various ways to make lamps of different shape. The frame arm 2 is generally deep-C shaped, and the bend intermediate of the frame arm 2 is preferably at an angle of about 120°.

Referring to FIG. 1, the three frame units are put together with the bends of the frame arm 2 inside and facing each other. When these three frame units 1 are correctly combined they are clamped at the lower bent portion of the frame arm 2 by means of lower holder 5 so that they will separate from each other. The lower holder 5 is made of metal or other suitable material and includes three curved channels 16 in the surface of the lower holder 5 so that they can receive and hold the lower intermediate bent portions of the frame arms 2 spaced apart by a predetermined gap respectively. The lower holder 5 is attached to the frame arm from its under side and receives the bent portion of the frame arm in the channel 16; thereafter a plate 6 is put on the lower holder 5 and they are clamped together by the screw 7 and nut 4. The lower holder 5 has a hole 17 and the plate 6 has a hole 9 aligning with said hole 17 so as to establish the above clamping.

Further, the three frame units 1 are correctly combined and held so as not to separate from each other at the upper bent portion of the frame arm 2 by means of upper holder 12. The upper holder 12 also is made of metal or other suitable material and includes three curved hollow channels 18 in the side of the upper holder 12 so that they can receive and hold the upper intermediate bent portions of the frame arms 2 spaced apart in a predetermined gap respectively. The lower holder 5 functions as a bed of the socket 8 when it is connected to the plate 6 as described hereinafter, while the upper holder 12 has only the function of a holding means. Therefore, the construction of the upper holder 12 is relatively simple. On the other hand, the upper holder preferably is made of a material that has some elasticity so as to engage with the frame arm, and it is preferred that the upper bent portion of the frame arm 2 be elastically fitted to the hollow channel 18. Then it is hard to remove the upper bent portion of the frame arm 2 from the upper holder 12.

After the three frame units 1 have been combined and clamped together as above described, the socket 8 for the light bulb is mounted. This socket 8 is put on the plate 6 connected to the frame arm 2 with the lower holder 5, and secured thereto. In order to secure the socket 8 to the plate 6, the socket 8 is provided with one or more clamping screws 11 through the hole thereof, the threaded portions of which project downward of the socket 8 through the hole 17 in the bottom of the socket 8. One or more threaded holes 10 are formed in the plate 6 and positioned in alignment with the clamping screw 11 so that the socket 8 is secured to the plate by screwing the clamping screws in the threaded holes 10 respectively. Alternatively, the socket 8 may be mounted on the upper holder. Then the frame structure of the lamp is composed.

Figure 2:
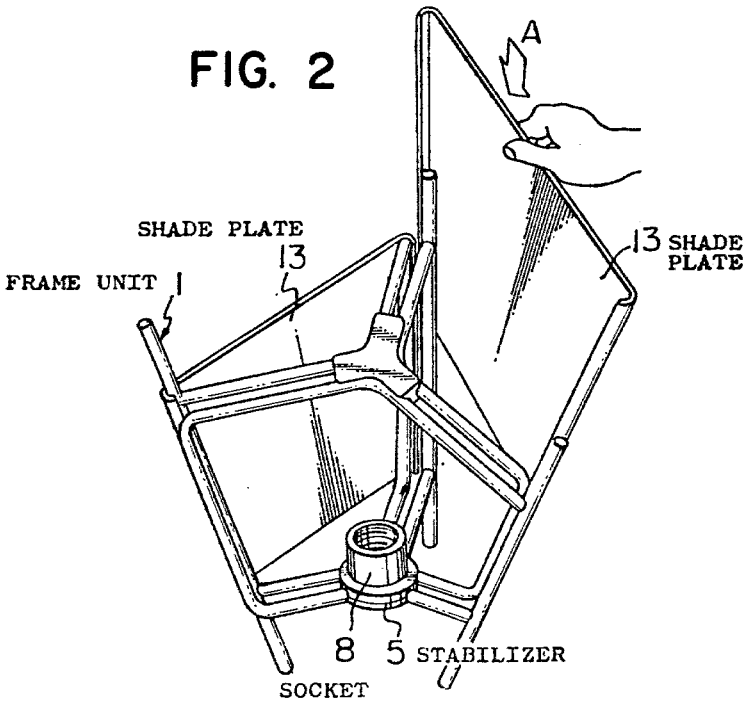
FIG. 2 is a perspective view showing the final step for assembling the lamp.

In the final step for assembling the lamp, the shade plates 13 are inserted in the frame structure as shown in FIG. 2. The shade plate 13 is a plate means made from vinyl chloride synthetic resin or other synthetic resin. The right and left ends of the shade plate 13 are bent inwards toward the same side. The semicircular bent portion of the shade plate 13 is curved so that the bent portion is enabled to fit to the pillar 3 (usually made of a circle bar) of the frame unit 1 and the vertical part (or spacer part) of the frame arm 2 parallel to the pillar. The separation between the two semicircular bent portions is made equal to or slightly less than that between the pillar 3 of the frame unit 1 and the spacer part of the frame arm 2 so that the semicircular bent portions of the shade plate 13 can rigidly engage with the pillar 3 and spacer part of the frame arm 2. Therefore, when the shade plate 13 is fixed to the frame unit 1 at the top (or bottom) thereof and is slid along the pillar 3 and the spacer part, the shade plate 13 moves downward to the position of the predetermined height, and when the shade plate has slid down to the predetermined position and the operation of pushing down the shade plate 13 is stopped, the shade plate 13 is held in place by the frictional force applied to the engaging area between the frame unit 1 and shade plate 13.

Figure 3:
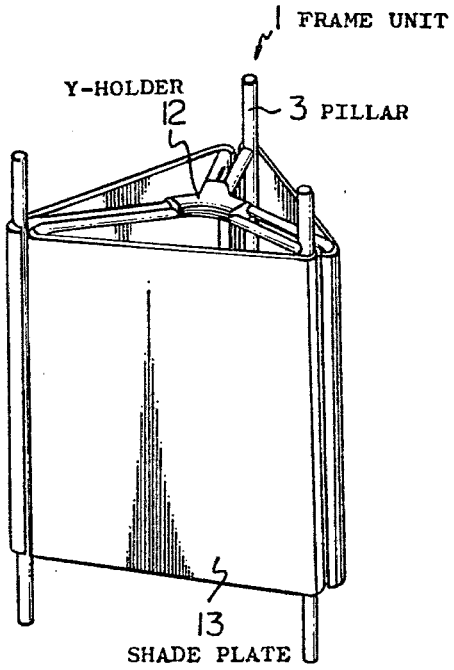
FIG. 3 is a perspective view of the finished lamp shown in FIG. 1.

As above described, one shade plate 13 is attached to one frame unit 1, and when the shade plates are attached to all of the three frame means respectively, a lamp having an external appearance as shown in FIG. 3 is finished.

Figure 4:
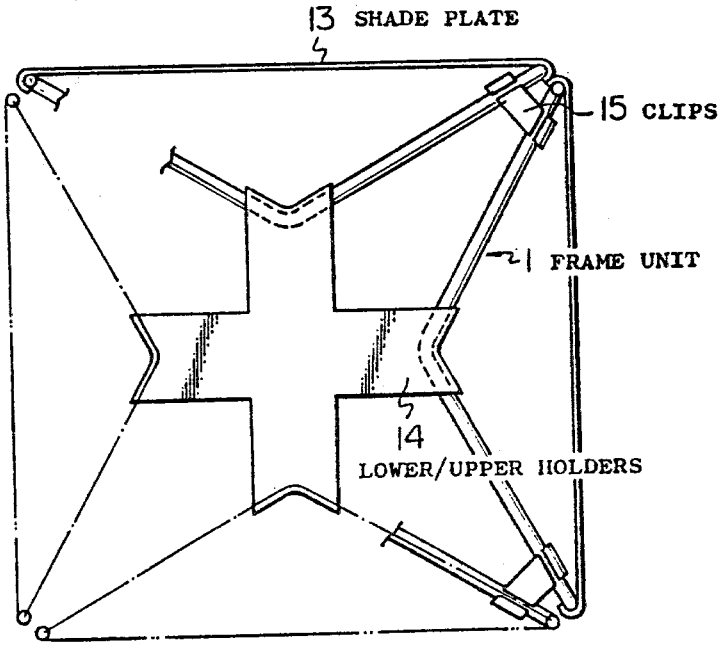
FIG. 4 is a plan view showing a modified lamp in which some part of the lamp is cut away.

FIG. 4 shows a modified (or second) embodiment of that shown in FIGS. 1 to 3 in which the frame structure is composed of four frame units 1. The lamp of this embodiment comprises substantially the same parts as those included in the lamp shown in FIGS. 1 to 3 except that the construction of the upper and lower holder (designated by numeral 14) is modified to some extent so as to clamp four frame units 1, and clip means 15 are provided at each of the four corners of the frame structure so as to join adjacent frame units to each other. The main parts, for example the frame units 1 and the shade plates 13 etc. of the second embodiment are the same as those used in the first embodiment. But, the shape of the second embodiment is rectangular in plan view which is far different from that of the first embodiment shown in FIGS. 1 to 3.

Because the lamp of the present invention is constructed as above described, this lamp can easily be disassembled and re-assembled, and the lamp can be easily changed from one shape to another.

I claim:

1. A lamp easily assembled and disassembled comprising:

a plurality of frame units each including a pillar extending vertically and first and second frame arms transversely extending from said pillar and joined to one another at their opposite ends by a vertically extending rod, each of said frame arms being bent at its intermediate portion, the bent portion of each of said frame units being disposed adjacent one another;

a lower holder attached to each of said first frame arms for clamping said frame units together;

an upper holder attached to each of said second frame arms;

a socket mounted on one of said upper and lower holders; and a plurality of shade plates each with two opposite edge portions thereof curved so as to define facingly disposed channels, one of said channels receiving therein said pillar, the other of said channels receiving therein said rod so as to secure said shade plate to said frame unit.

2. The lamp of claim 1 wherein each said frame arm is bent at its intermediate portion to define an angle of approximately 120°.

3. The lamp of claim 1 wherein the number of frame units is three.

4. The lamp of claim 1 wherein the number of frame units is four.

5. The lamp of claim 1 wherein each of said shade plates is a substantially flat plate and said facingly disposed channels have slightly less separation than said pillar and said rod on each frame unit prior to assembly.

6. A lamp comprising:

a plurality of frame units, each of said frame units being defined by first and second generally parallel side members joined to top and bottom members so as to define a generally open frame unit, said top and bottom members being bent through an angle intermediate said first and second side members and about an axis parallel thereto;

first coupling means for coupling a plurality of frame units adjacent said top members;

second coupling means for coupling said plurality of frame units adjacent said bottom members, one of said first and second coupling means having electrical socket means for receiving and energizing a light bulb; and a plurality of shade plates each with two opposite edge portions thereof curved so as to define facingly disposed channels, one of said channels receiving therein said first side member, the other of said channels receiving therein said second side member to secure said plate to said frame unit.

7. The lamp of claim 6 wherein each of said shade plates is a substantially flat plate and said facingly disposed channels having slightly less separation than said first and second side members of each of said frame units when in the free state.

8. The lamp of claim 6 wherein each of said frame units has one of its side members extending beyond each of said top and bottom members.

9. The lamp of claim 6 wherein said top and bottom members of each said frame unit are bent to define an angle of approximately 120°.

10. The lamp of claim 6 wherein the number of frame units is three.

11. The lamp of claim 6 wherein the number of frame units is four.

* * * * *